US005738172A

United States Patent [19]

van Mook et al.

[11] Patent Number: 5,738,172

[45] Date of Patent: Apr. 14, 1998

[54] FILTER FOR FLUID CIRCUITS

[75] Inventors: Brian J. van Mook; Mario R. Lugo, both of Houston; Larry D. Douglas, Cypress; Terry Lee McInturff, Tomball, all of Tex.

[73] Assignee: Oceaneering International, Inc., Tomball, Tex.

[21] Appl. No.: 640,065

[22] Filed: Apr. 30, 1996

[51] Int. Cl.[6] ..... E21B 34/10; E21B 43/01; E21B 43/08

[52] U.S. Cl. ..... 166/344; 166/205; 166/228; 166/348; 166/374; 166/382; 166/386

[58] Field of Search ..... 166/75.13, 91.1, 166/205, 227, 228, 229, 319, 320, 321, 322, 323, 324, 344, 348, 374, 378, 381, 382, 386

[56] References Cited

U.S. PATENT DOCUMENTS

| | | | |
|---|---|---|---|
| 3,827,501 | 8/1974 | Johnson et al. | 166/321 X |
| 3,850,238 | 11/1974 | Hill | 166/374 |
| 4,431,051 | 2/1984 | Adams, Jr. | 166/375 X |
| 4,442,902 | 4/1984 | Doremus et al. | 166/374 |
| 5,088,554 | 2/1992 | Arterbury et al. | 166/228 |
| 5,088,558 | 2/1992 | Mohn | 166/344 X |
| 5,139,085 | 8/1992 | Duvallet | 166/321 X |

OTHER PUBLICATIONS

Baker, Ron, *A Primer of Oil Well Drilling*, Published by Petroleum Extension Service, Fourth Edition, Revised, 1979, pp. 58, 61.

*Primary Examiner*—George A. Suchfield
*Attorney, Agent, or Firm*—Rosenblatt & Redano, P.C.

[57] ABSTRACT

The invention relates to a filter which is useable in conjunction with subsea hydraulic control circuits. The filters incorporated in a housing which can be stabbed in or out of a control unit to become part of one or more fluid control circuits. The stab-type housing can be inserted with a remotely operated vehicle. Other configurations involve long, slender housings for use with subsurface safety valve control lines as well as with tubing hanger housings. The slender design allows mounting right on the production tubing. A rupture disc feature is available so that if excessive pressure differential is obtained due to clogging, the filter unit within the housing can be bypassed to allow continuing operation.

19 Claims, 5 Drawing Sheets

FILTER FOR FLUID CIRCUITS

FIELD OF THE INVENTION

The field of this invention relates to filters used in hydraulic circuits, chemical injection circuits, primarily for subsea and/or subsurface applications.

BACKGROUND OF THE INVENTION

In the past, wells have used subsurface safety valves which are actuated through the use of hydraulic control lines which run to the surface. In subsea applications hydraulic systems have components which are situated on the sea bed or elsewhere below the water line which are routinely serviced by remotely operated vehicles. As these hydraulic systems function they pick up foreign materials which must be filtered out. Frequently the presence of particulates in the circulating hydraulic fluid can cause severe damage to the downhole components. Accordingly, a series of filter units have been developed as a part of the present invention with the objective of being useful for the intended application so that maintenance is greatly facilitated when a filter change-out is required. Thus, one of the objectives of the present invention is to incorporate filtration units into what are referred to in subsea applications as "hot stabs" which are inserts into subsea hydraulic housings to direct flow of hydraulic fluid from one place to another. In another application, the object is to provide a long and slender profile for an inline filter which is particularly adaptable for use with subsurface safety valve control systems and chemical injection systems. Another adaptation is to employ the filtration mechanisms disclosed in conjunction with the body of the tubing hanger in the control line itself, again to facilitate maintenance when necessary. These and other objectives of the filtration devices disclosed will become more apparent to those of ordinary skill in the art from a review of the detailed description below.

SUMMARY OF THE INVENTION

The invention relates to a filter which is useable in conjunction with subsea hydraulic control circuits. The filters incorporated in a housing which can be stabbed in or out of a control unit to become part of one or more fluid control circuits. The stab-type housing can be inserted with a remotely operated vehicle. Other configurations involve long, slender housings for use with subsurface safety valve control lines as well as with tubing hanger housings. The slender design allows mounting right on the production tubing. A rupture disc feature is available so that if excessive pressure differential is obtained due to clogging, the filter unit within the housing can be bypassed to allow continuing operation.

DETAILED DESCRIPTION OF THE PREFERRED EMBODIMENT

Figure 1:
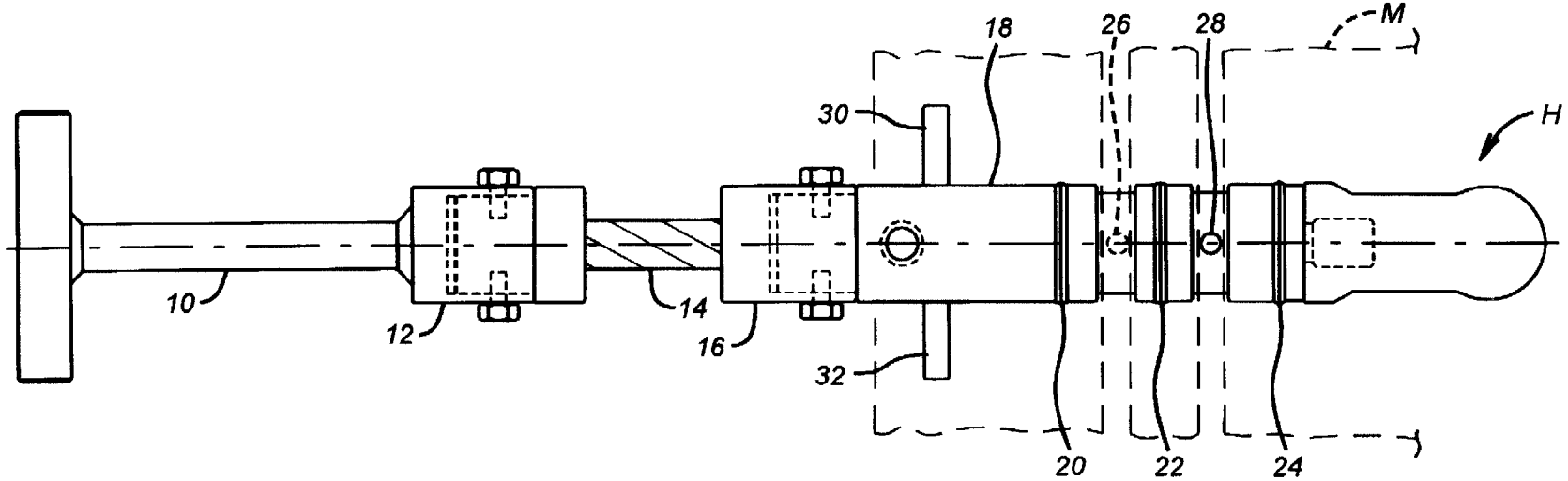
FIG. 1 is an assembly drawing of a male hot stab unit which has the filter of the present invention therein.

Referring now to FIG. 1, the general configuration of a subsea hot stab is illustrated. The hot stab H disclosed in FIG. 1 has a handle 10 and a connecting link 12 which is tied to a wire rope coupling 14. Another connector 16 is connected to the coupling 14. The body 18 has a series of seals 20, 22, and 24 whose quantity varies with the particular design. Between the seals 20, 22, and 24, are ports such as 26 and 28. When the hot stab H is inserted into a particular manifold M it helps to complete one or more hydraulic circuits depending on the orientation of the openings, such as 26 and 28.

Figure 2:
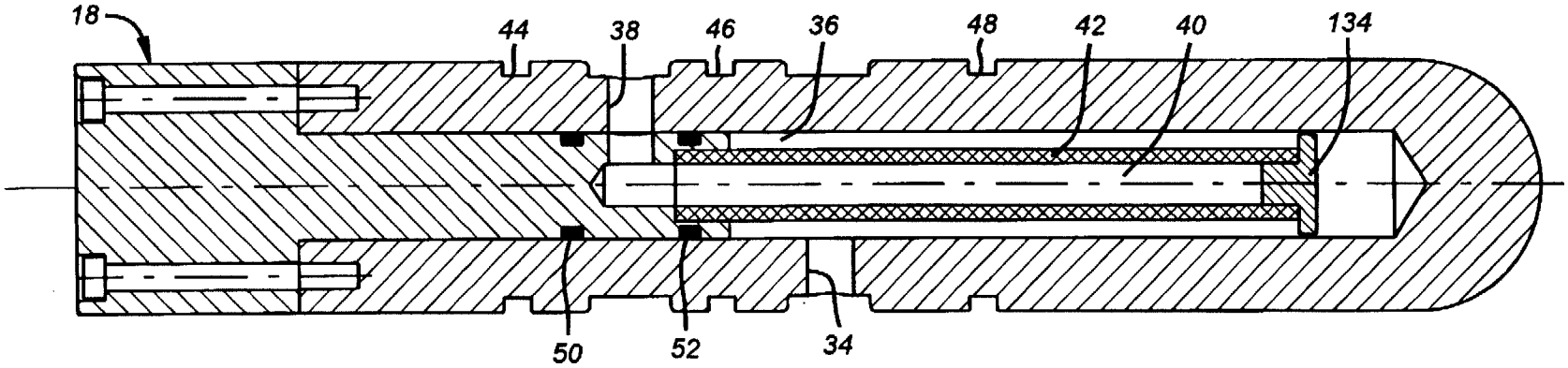
FIG. 2 is a section view through a dual port hot stab.

To assist in retaining the hot stab H to a manifold M, it is mounted bayonet style and turned a quarter turn so that the lugs 30 and 32 are retained to the manifold M when the openings 26 and 28 are in their proper orientation. The description with regard to FIG. 1 is given by way of background to aid in understanding the application of the apparatus of the present invention. One embodiment is illustrated by referring to FIG. 2 where the body 18 of the hot stab H is illustrated. Inside the hot stab is the filter assembly 42 which in the preferred embodiment is a 10 micron sintered metal filter element in a tubular shape other materials and opening sizes can be used without departing from the spirit of the invention. The housing such as 18 is corrosion resistant and is preferably made of a corrosion resistant austenitic stainless steel with a pressure rating range of approximately 3,000–15,000 psi. The body 18 has an inlet 34 which goes to an annular space 36. Body 18 has an outlet 38 which is connected to the inside 40 of the filter element 42. Thus, the flow through the body 18 is from the inlet 34 into the annular space 36 through the filter body 42 and into the internal space 40 and ultimately out the outlet 38. Grooves 44, 46, and 48 hold seals such as 20, 22, and 24 shown in FIG. 1. When the stab of FIG. 2 is inserted into a manifold M it completes a hydraulic circuit which now has a filter in it. Seal 50 prevents external leakage from the body 18 while seal 52 prevents communication between the annular space 36 and the outlet 38. The body 18 can be inserted into a manifold M while a hydraulic system is being flushed for commission so that any foreign material is retained in the annular space 36. It can then be replaced with another stab optionally without the filter 42. Alternatively, the body 18 as shown in FIG. 2 can be initially installed in a system with the filter 42 retained to continue filtration during use of the hydraulic system. Periodically, the stabs H can be replaced by a remotely operated vehicle and the replacement stab H can contain a clean filter element 42.

Figure 3:
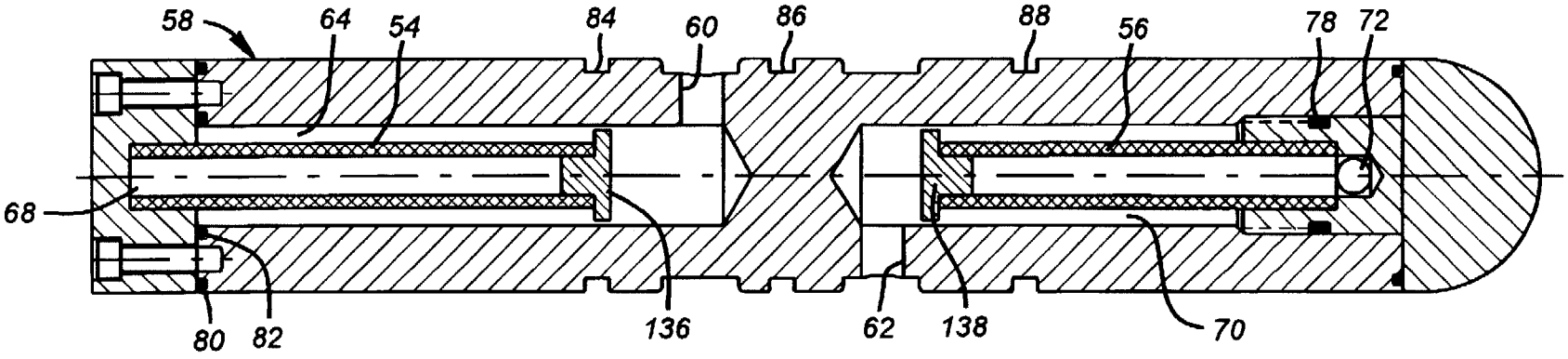
FIG. 3 is an alternative embodiment of the hot stab.
Figure 4:
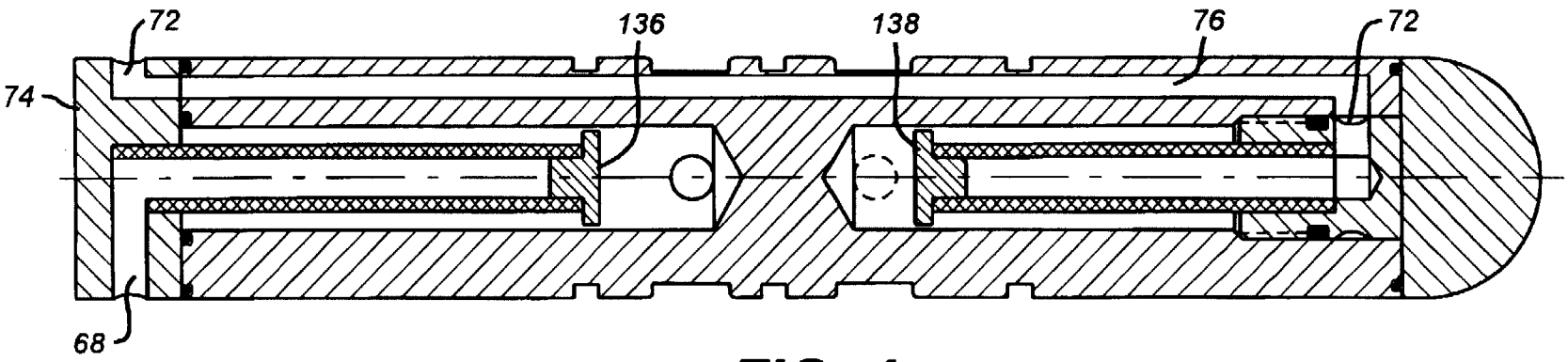
FIG. 4 is FIG. 3 rotated 90°.

FIGS. 3 and 4 are rotated views of a different design of a stab H which has multiple filter elements 54 and 56. The single body 58 has outlets 60 and 62. Flow comes into inlet 68 and goes into space 64 through the filter 54 and out the outlet 60 which can be better seen in FIG. 4. Similarly, fluid coming into inlet 72 goes into a space 70 then through the filter 56 and finally out outlet 62 which can be better seen in FIG. 4. Inlet 72 is generally located toward the top end 74 of the body 58 via an internal passage 76. In that manner, both inlets 72 and 68 are near the top of the body 58. It should be noted in FIGS. 3 and 4 that seals 78 prevent short circuiting of flow from the space 70 to the inlet 72. Seals 80 and 82 prevent leakage out of the body 58 from space 64. Grooves 84, 86, and 88 are for seals such as 20, 22, and 24 as shown in FIG. 1 and help isolate outlet 60 from outlet 62. They also prevent leakage out of the manifold M from outlets 60 and 62.

Figure 5:
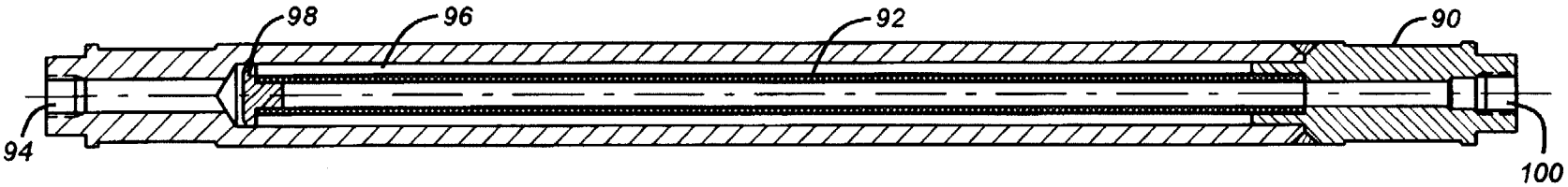
FIG. 5 is an alternative embodiment showing an application for a subsurface safety valve hydraulic control circuit.

Referring now to FIG. 5, a slim design of a housing 90 has the filter element 92 mounted therein. The inlet 94 is in fluid communication with an annular space 96 as flow goes around a centralizer 98 which caps off one end of the filter 92 and keeps it centralized within the housing 90. Flow goes from the annular space 96 through the body of the filter and into outlet 100. The profile of the housing 90 is small, generally in the order of about one inch in diameter so that several housings for several hydraulic circuits can be attached to a production line as it passes through a well head. Typically two or four such housings 90 are employed and secured around the production tubing for ultimate use in various downhole hydraulic circuits such as for control of a subsurface safety valve. These units can be placed in close proximity to the final controlled element to be sure that any scale or other foreign materials that break off from the long run of control line tubing from the surface does not foul the control components in the subsurface safety valve or other final control element. The preferred material for the filter elements disclosed including element 92 is a sintered metal tubular element having openings of approximately 10 microns. The housing 90 can be replaced if the filter 92 becomes clogged to allow continuing well operations. The advantage to the operator is that the functionality of the final control element such as the subsurface safety valve is assured with the filter 92 being as close as possible to the subsurface safety valve or other final control element. Additionally, the housing 90 can be removed to the surface with the final control element, to facilitate changes of the filter 92 in the housing 90.

Figure 6:
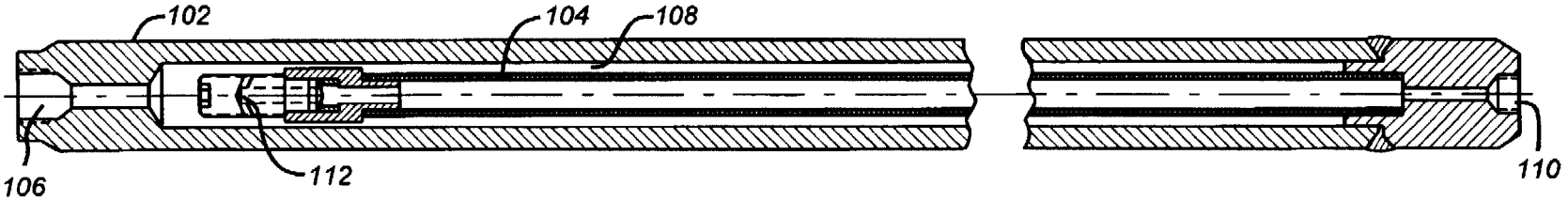
FIG. 6 is an alternative embodiment for a subsurface safety valve control system to the embodiment shown in FIG. 5.

FIG. 6 is a variation of the design shown in FIG. 5. FIG. 6 has a housing 102 within which is a tubularly shaped filter element 104. Again, the preferred material is a sintered metal having a 10 micron opening size. The normal flow is from the inlet 106 into annulus 108 through the filter 104 and out the outlet 110. The difference in the preferred embodiment of this slender design which is in the order of approximately an inch in diameter, is that internally to housing 102 and blocking up an end of the filter 104 is a rupture disc assembly 112. If the differential pressure between the annulus 108 and the outlet 110 rises to a particular predetermined value, the rupture disc 112 will break, thus allowing the circulating hydraulic fluid coming in at inlet 106 to bypass the filter 104 as it passes directly through the now broken rupture disc 112. In all other respects, the design of FIG. 6 operates similarly to FIG. 5.

Figure 7:
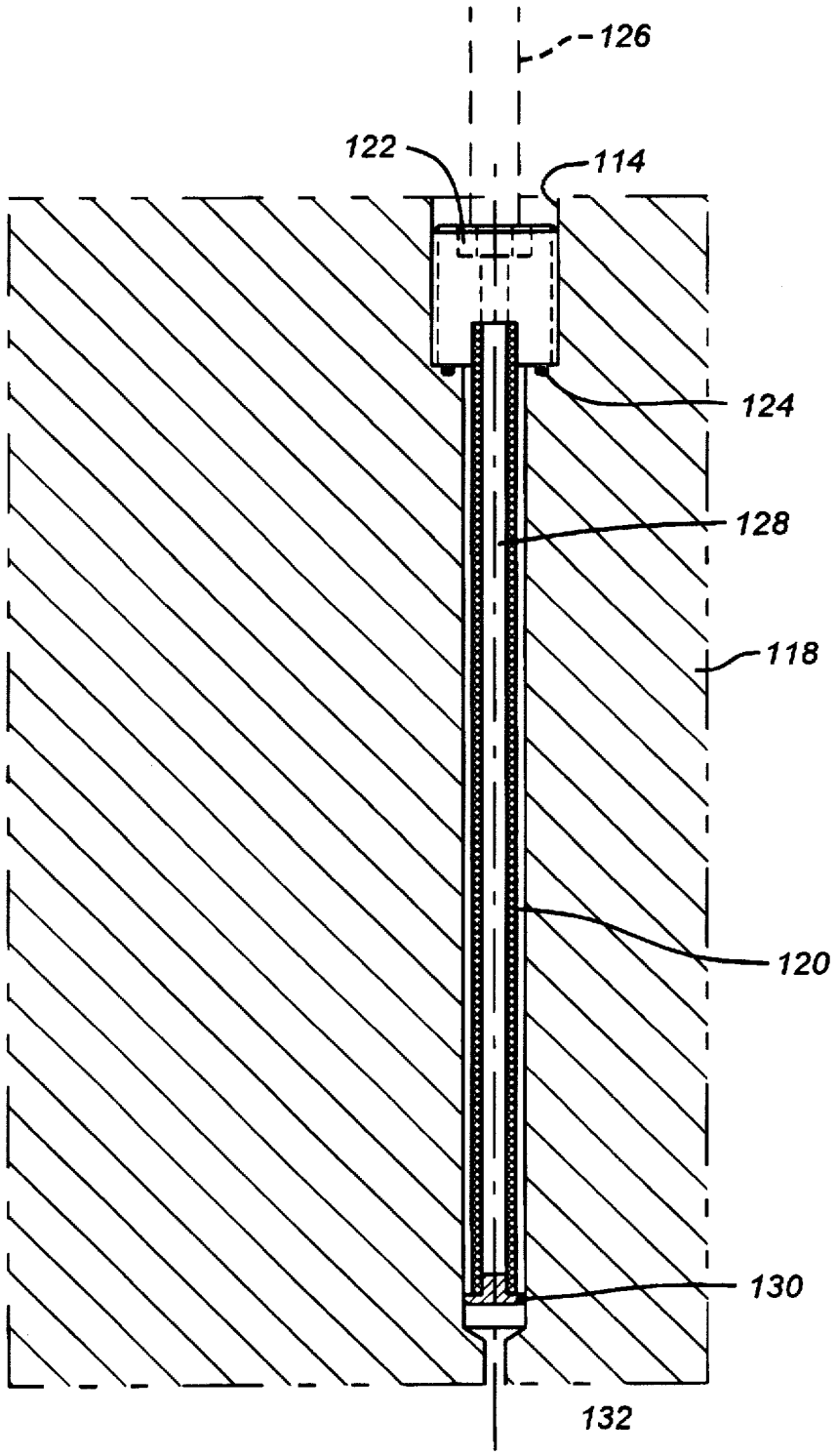
FIG. 7 schematically illustrates the use of the invention within the body of a tubing hanger.
Figure 8:
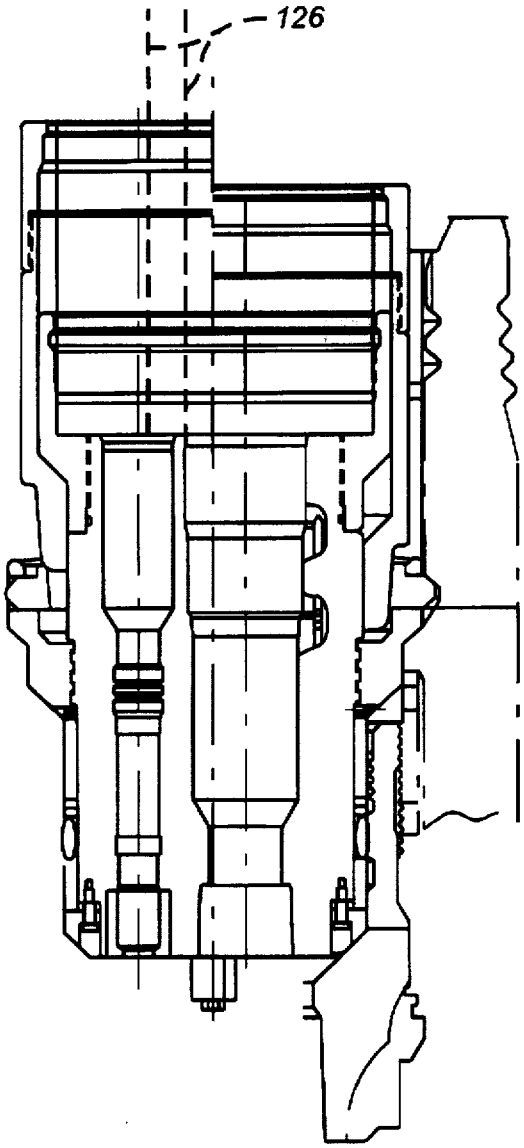
FIG. 8 is an assembly view in elevation of a typical tubing hanger assembly.
Figure 9:
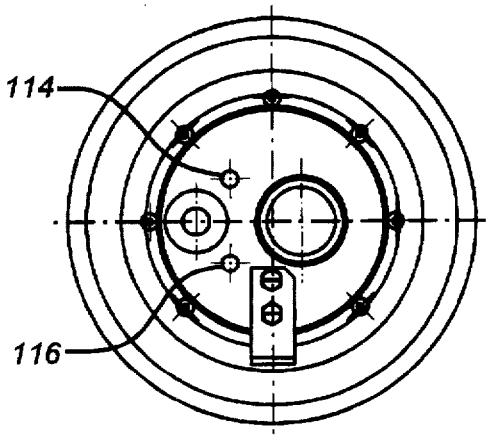
FIG. 9 is a top view of FIG. 8 which shows the location of the hydraulic line connections in a tubing hanger.

Referring now to FIGS. 7 through 9. There is illustrated the use of the filters as previously described in conjunction with a tubing hanger. A tubing hanger is generally shown in FIG. 8 in elevation view and in FIG. 9 in plan. Hydraulic lines for actuating the tubing hanger are connected typically at inlets 114 and 116 shown in FIG. 9. One such connection 114 is illustrated in the schematic of FIG. 7. The body 118 may require minor machining modifications to accommodate the filter 120. The inlet 114 accommodates end cap 122 which is held in a sealing relationship to the body 118 by virtue of seal 124. The end cap 122 is generally threaded into the body 118 while the seal 124 secures its position and sealing relationship to the body 118. A typical hydraulic line is shown schematically in dashes as 126 and is connected to the end cap 122. Flow proceeds from line 126 into the internal area 128 of the filter 120 which again is preferably made from sintered rectal with 10 micron openings. The flow then passes through the filter and around the end cap/centralizer 130 until it can emerge from outlet 132. Again, the sensitive components downstream are protected by virtue of this filter 120 which can be easily serviced by removal of line 126 from the body 118 and replacing the filter assembly with a new filter and reassembling into the condition shown in FIG. 7 for continuing operations. The advantage of the filter 120 is that it is close to the final controlled elements which again protects such elements from scale or other materials which can break loose in the control line from the surface down to the point where the tubing hanger body 118 is situated. It should be noted that the tubing hanger body 118 can be made initially to accommodate the filter 120 or such minor modifications can be done on a preexisting unit with minor machining.

Accordingly, what is disclosed is a simple design which allows for appropriate filtration of hydraulic control lines preferably closer to the point of the final control element. These applications readily lend themselves to subsurface and subsea type well installations where long runs of control tubing are a frequent occurrence. Those skilled in the art will appreciate that the filter elements in the various embodiments shown can be easily replaced and that access when needed for such replacement is facilitated by the design that has been described. The filter material and opening size can be varied without departing from the spirit of the invention as well as the other dimensions for the filter. The rupture disc feature illustrated in FIG. 6 is optional and does provide the added advantage of allowing continuing well operations should the filter such as 104 actually plug up. Since conditions in the hydraulic control system are monitored on a regular basis, the progressive accumulation of debris in the annular space 108 can be monitored at the surface as a pressure build up. Even if this should occur quickly, the subsurface safety valve will continue to function if the rupture disc feature 112 is present. However, at some point thereafter maintenance on the system would be appropriate. It should be noted that the centralizer such as 98 serves a double duty as being an end cover as well as a centralizer. The centralizing feature can be optionally removed so that only the end capping feature is utilized. However, by combining in the design a centralizing feature along with an end plugging feature, the performance of the unit such as depicted in FIG. 5 is improved. Such a design such as shown in FIG. 5 as centralizer 98 is also shown as 134 in FIG. 2 and 136 and 138 in FIGS. 3 and 4.

The foregoing disclosure and description of the invention are illustrative and explanatory thereof, and various changes in the size, shape and materials, as well as in the details of the illustrated construction, may be made without departing from the spirit of the invention.

We claim:

1. A method of filtering within a fluid control system for a well comprising:

putting at least one filter element in a housing;

securing the housing in the control system where it is selectively removable;

forming said housing as part of a hot stab assembly;

inserting or removing said housing in a subsea manifold.

2. The method of claim 1 wherein:

using a remote operated vehicle to insert or remove said hot stab assembly.

3. The method of claim 2 wherein:

providing a plurality of filters in said housing each with its own inlet and outlet or said housing;

providing filtration for a plurality of fluid circuits by insertion of a single hot stab assembly.

4. A method of filtering within a fluid control system for a well comprising:

putting at least one filter element in a housing;

securing the housing in the control system where it is selectively removable;

providing a barrier into said filter that opens at a predetermined differential pressure;

allowing said barrier to break when the pressure drop across said filter exceeds a predetermined value;

bypassing said filter within said housing when said barrier is broken.

5. The method of claim 1 further comprising:

providing an elongated shape to said housing conforming to an annularly shaped filter therein.

6. The method of claim 5 further comprising:

plugging one end of said filter with a plug that also serves as a centralizer for the filter in said housing.

7. The method of claim 6 further comprising:

forcing fluid to flow into an annular space between said filter and said housing;

directing the fluid from said annular space to within said filter;

allowing filtered fluid to exit said housing.

8. The method of claim 7 further comprising:

providing a barrier into said filter that opens at a predetermined differential pressure;

allowing said barrier to break when the pressure drop across said filter exceeds a predetermined value;

by passing said filter within said housing when said barrier is broken.

9. The method of claim 5, further comprising:

bundling a plurality of said elongated housings on production tubing near a well head for filtration of various hydraulic circuits.

10. The method of claim 5 further comprising:

using said housing in a system for control of a subsurface safety valve.

11. The method of claim 9 further comprising:

using at least one of said housings for control of a subsurface safety valve.

12. A method of filtering within a fluid control system for a well comprising:

putting at least one filter element in a housing;

securing the housing in the control system where it is selectively removable;

using as said housing a modified tubing hanger body;

inserting said filter in said tubing hanger body where it is selectively removable.

13. The method of claim 1, further comprising:

using a sintered metal annularly shaped tube as said filter.

14. The method of claim 3, further comprising:

using a sintered metal annularly shaped tube as said filter.

15. The method of claim 4, further comprising:

using a sintered metal annularly shaped tube as said filter.

16. The method of claim 5, further comprising:

using a sintered metal annularly shaped tube as said filter.

17. The method of claim 7, further comprising:

using a sintered metal annularly shaped tube as said filter.

18. The method of claim 8, further comprising:

using a sintered metal annularly shaped tube as said filter.

19. The method of claim 12, further comprising:

using a sintered metal annularly shaped tube as said filter.

* * * * *